United States Patent [19]

Harward

[11] Patent Number: 4,824,020

[45] Date of Patent: Apr. 25, 1989

[54] SPRINKLER STAND

[75] Inventor: Randall T. Harward, Spanish Fork, Utah

[73] Assignee: Harward Irrigation Systems, Inc., Spanish Fork, Utah

[21] Appl. No.: 31,353

[22] Filed: Mar. 30, 1987

[51] Int. Cl.[4] ..... B05B 15/06

[52] U.S. Cl. ..... 239/264; 239/280; 239/565; 239/550; 248/83; 248/163.1; 248/188

[58] Field of Search ..... 239/264, 265, 280, 280.5, 239/281, 550, 565; 248/83, 84, 163.1, 188, 188.6

[56] References Cited

U.S. PATENT DOCUMENTS

| | | | |
|---|---|---|---|
| 786,740 | 4/1905 | Duncan | 248/163.1 |
| 1,746,575 | 2/1930 | Baner | 239/550 X |
| 1,812,967 | 7/1931 | Long | 248/188 X |
| 1,959,886 | 5/1934 | Wadsworth | 239/280.5 |
| 2,496,519 | 2/1950 | Culbertson | 248/188 |
| 2,631,802 | 3/1953 | Tunis | 248/188.6 X |
| 2,694,600 | 11/1954 | Richey | 239/280 X |

FOREIGN PATENT DOCUMENTS

| | | | |
|---|---|---|---|
| 1498296 | 9/1967 | France | 239/550 |
| 197801 | 5/1923 | United Kingdom | 248/188 |

*Primary Examiner*—Andres Kashnikow
*Assistant Examiner*—Mary Beth O. Jones
*Attorney, Agent, or Firm*—Thorpe, North & Western

[57] ABSTRACT

A lightweight vertical support stand for a water sprinkler head comprises a central support hub and at least five flexible elongate legs attached to the support hub. The legs are pivotally attached so that they can be positioned in an extended support position or can be gathered in a bundle for moving and storage. The support stands for the water sprinkler heads are used in an agricultural irrigation system in which lateral water conduits are provided at spaced positions across the area to be irrigated. Quick disconnect couplings are provided in the lateral conduits, and the support stands and sprinkler heads are adapted to be quickly engaged with the couplings in the lateral conduits.

15 Claims, 2 Drawing Sheets

SPRINKLER STAND

BACKGROUND OF THE INVENTION

1. Field

The present invention relates to portable water sprinkler apparatus of the type which has an elevated sprinkler head for distributing water over tall foliage and for covering larger areas per sprinkler head than can be achieved with ground level sprinkler heads. The present invention further relates to systems for agricultural irrigation using the elevated, portable sprinkler apparatus.

2. State of the Art

There are various sprinklers used in residential and agricultural irrigation wherein the sprinkling action or projection of water is produced by passing the water through a nozzle, wherein the water is ejected from the nozzle as a coherent stream. The stream of water generally breaks up as it passes through the air, with water droplets falling from the stream over the entire trajectory of the ejected stream. In one type sprinkler, an oscillating impact member is used to physically break the stream of water so as to provide additional water distribution in the area adjacent to and relatively near the sprinkler. In addition, the impact member is also used to produce a force to rotate the nozzle about a generally vertical axis.

It has been recognized that by elevating the sprinkler nozzle above the level of the ground which is being irrigated, the area covered by a single sprinkler nozzle can be increased. Further, it has been recognized advantageous to raise the sprinkler nozzle above growing crops, shrubbery or other obstacles to allow the ejected stream of water to pass over the obstacles. Otherwise, the sprinkler has to be moved several times to avoid the obstacles and to avoid shadowing or dry spots caused by the obstacles.

Tripod stands have been suggested comprising a standpipe which extends vertically through the hub of the tripod stand. See, for example, U.S. Pat. No. 1,959,886, issued to Willard Wadsworth on May 22, 1934. Experience has shown that the tripod stands are generally unstable when a sprinkler head is used in which a stream of water is forcefully ejected laterally in one direction through a nozzle from the sprinkler head. Such sprinkler heads are generally adapted to rotate about a vertical axis with an impact device which interacts with the ejected stream of water to rotate the sprinkler head. One such commonly available sprinkler head is sold under the tradename "Rainbird" by Rainbird Sales Corporation of Glendora, Calif. Unfortunately, the reactive force of the ejected water stream from the sprinkler head acts with the movement are created by the height of the sprinkler stand to tip the stand over. The situation is aggravated if there is a breeze or wind which increases the tilting force on the stand To alleviate the instability problem inherent with the elevated sprinkler stand, the stand can be weighted or made of a heavy construction. This, however, greatly reduces the usefulness of the stand as a portable apparatus. As shown in U.S. Pat. No. 2,694,600, issued to Albert E. Rickey on Nov. 16, 1954, a heavy, circular base member is provided, with the tripod supported permanently on the circular base member. Wheels were provided for moving the large and cumbersome stand from one place to another.

Heretofore, to the best of the present inventor's knowledge, there has been no suggestion of utilizing a vertical support stand for a water sprinkler head wherein the stand comprises a central support hub with a sprinkler head coupled thereto and further with at least five, flexible, elongate legs attached to the support hub such that the legs are equally spaced around the support hub and extend outwardly in an acute angle from the central, vertical axis through the support hub.

OBJECTIVES

It is a principal objective of the present invention to provide a generally lightweight, portable support stand for vertically elevating a water sprinkler head, wherein the stand can be easily and quickly moved from place to place. An additional objective of the present invention is to provide such a portable support stand for a water sprinkler head, wherein the stand is stable and is not subject to being overturned by the reaction forces resulting from water being ejected from the sprinkler head or a combination of such reaction forces and wind to which the stand may be subjected.

A specific objective of the present invention is to provide a portable support stand for a water sprinkler head, wherein the stand comprises a central support hub from which pivotally extend five or more flexible elongate legs, with the legs being pivotable from an outwardly extending position in which the legs make an acute angle from the central, vertical axis through the support hub to a retracted position in which the legs extend from the central hub in closely spaced, substantially parallel relationship. An additional specific objective of the present invention is to provide such a portable support stand in which the ends of the flexible, elongate legs, which are pivotally attached to the support hub, are received within slotted receptacles in the hub to guide the elongate legs in their pivotal movement A further specific objective of the present invention is to provide such a portable support stand in which the slotted receptacles are provided with means for releasably retaining the mutually respective legs in selected positions in their pivotal movement.

Another general objective of the present invention is to provide a relatively inexpensive agricultural irrigation system comprising one or more portable generally lightweight, support stands for water sprinkler heads, a system of lateral water conduits extending in spaced positions on the field to be irrigated, and means for quickly connecting and disconnecting the water sprinkler heads on the portable support stands to the lateral water conduits, wherein the support stands and their mutually respective sprinkler heads can be quickly and easily moved from position to position along the water conduits in the field.

BRIEF DESCRIPTION OF THE INVENTION

The above objectives are achieved in accordance with the present invention by a novel vertical support stand for a water sprinkler comprising a central support hub from g which at least five, flexible, elongate legs are pivotally attached. The flexible legs are substantially equally spaced around a central, vertical axis through the support hub whereby the legs can be pivoted to an extended support position in which the legs extend outwardly in an acute angle from the central axis. A sprinkler head is coupled to the top of the support hub, and means are provided for further coupling a conduit to the support head, with the conduit being in flow communication through the support hub with the sprinkler head. The conduit is adapted to be connected to a pressurized source of water to provide water under pressure to the sprinkler head.

The lower ends of the legs contact the ground, and the legs support the hub and sprinkler head at a vertical height above the ground. The flexibility of the legs, together with the proviso that at least five legs be utilized, combines to achieve remarkable stability for the stand and water sprinkler. The reactive force on the stand resulting from the water sprinkler is apparently dissipated through the flexible legs. The stand is completely stable and will not turn over or fall on its side even under stiff wind conditions which otherwise increase the tendency of a vertically elevated sprinkler stand to turn or fall over on its side.

The support stand, including the sprinkler head, is very lightweight and can be quickly and easily moved. In g this respect, the stand is particularly advantageous when used in an inexpensive agricultural irrigation system. To minimize costs, the agricultural system comprises relatively small lateral conduits spaced on the field which is to be irrigated. The size of the lateral conduits is maintained at a minimum because only a limited number of sprinkler heads will be supplied by the conduit at any one time. Each lateral conduit is provided with quick disconnect couplings spaced therealong. The portable sprinkler stand, including the sprinkler head, has a connecting conduit associated therewith which can be quickly connected and disconnected from the quick disconnect couplings on the lateral conduits. When the area around one of the quick disconnect couplings on a lateral conduit has been irrigated, the portable stand and sprinkler head is disconnected and quickly moved to the next quick disconnect coupling for irrigation of the field in the vicinity of that coupling.

The entire field is irrigated by subsequently moving the portable stand and sprinkler head from place to place along the lateral conduits. By limiting the number of sprinkler heads connected at any one time to a single lateral conduit to no more than two or three, the size of the lateral conduit, i.e., the diameter of the conduit, can be minimized. In conventional sprinkler irrigation systems, each water supply conduit has numerous sprinkler heads which spray simultaneously when the system is in operation. To g provide sufficient water for the numerous sprinkler heads, the water supply conduit must be adequately sized, such as four or five inches in diameter or even larger. Such systems are very costly. The present sprinkler irrigation system provides a much less costly alternative, wherein lightweight, portable sprinklers are moved in serial fashion along a water supply conduit such that only a limited number of sprinkler heads are being provided water at any one time from the water supply conduit. The size of the conduit can be substantiallay reduced, which in turn greatly reduces the cost of the system.

Additional objects and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which.

DETAILED DESCRIPTION OF THE ILLUSTRATED EMBODIMENTS

Figure 1:
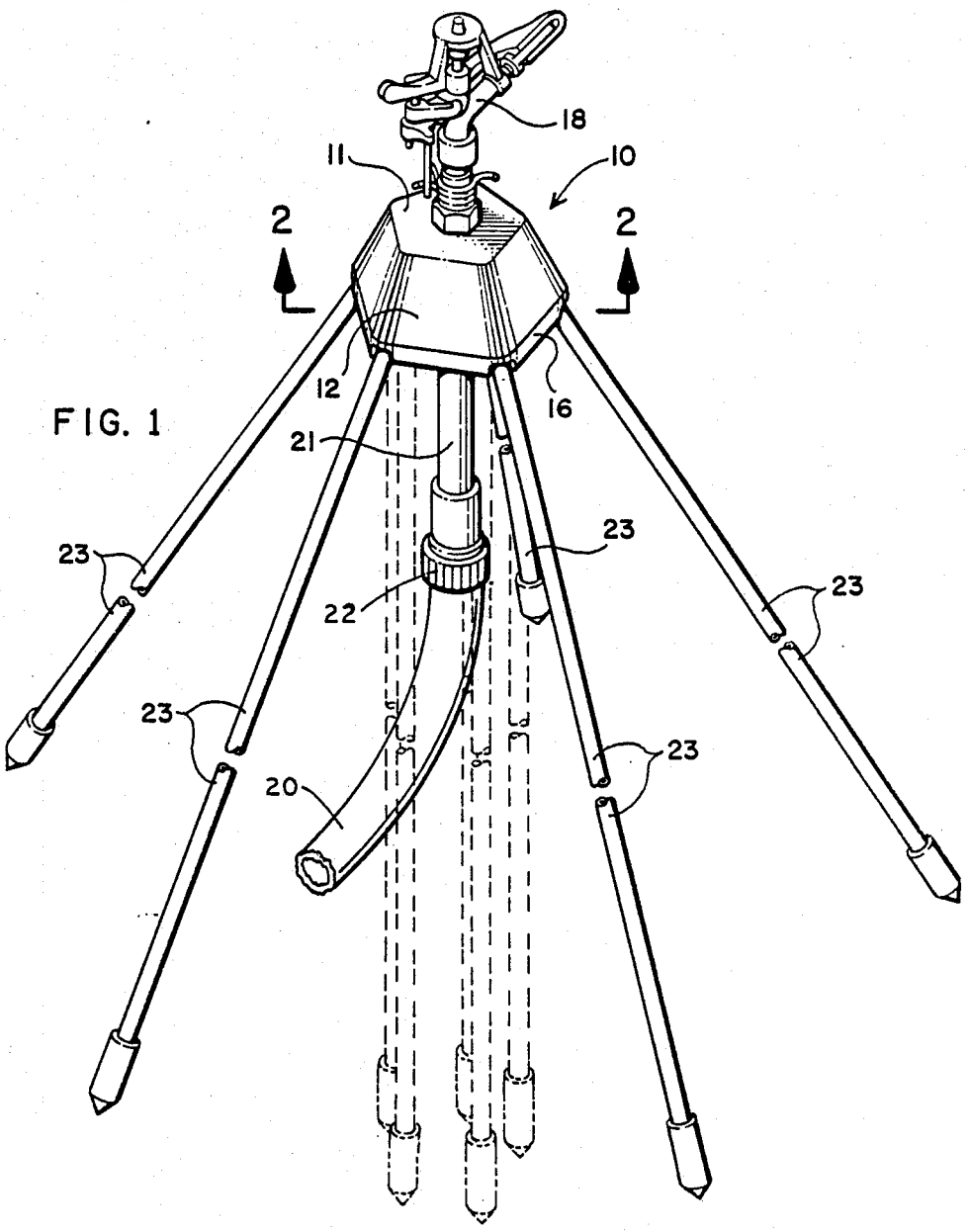
FIG. 1 is a pictorial of a relatively lightweight, vertical support stand for a water sprinkler head in accordance with the invention, showing a water sprinkler head installed thereon.
Figure 2:
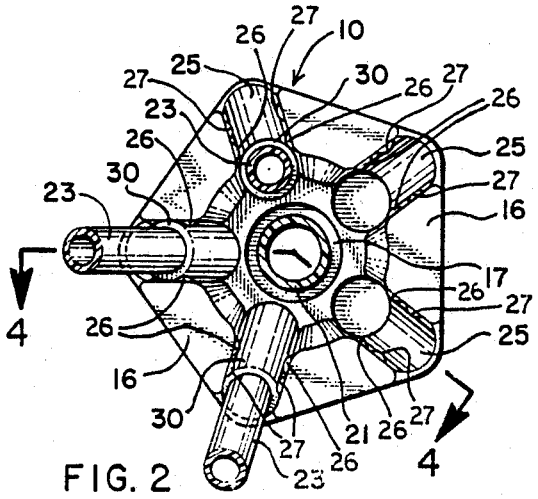
FIG. 2 is a bottom view of the body member of the support stand of FIG. 1, looking upwardly along line 2—2 of FIG. 1 with two of the legs of the stand being omitted and the other three legs in the three various leg positions respectively.
Figure 3:
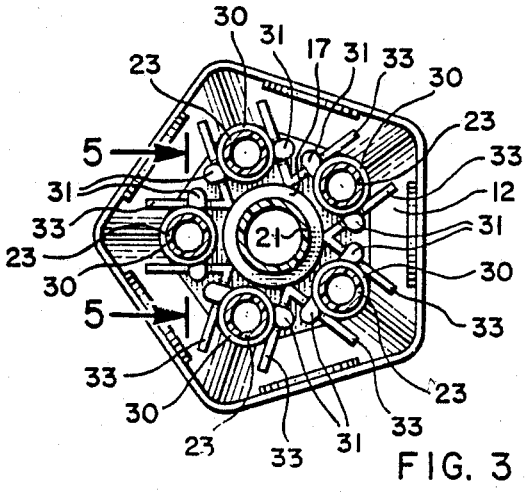
FIG. 3 is a bottom view similar to FIG. 2 but with the bottom portion of the body member omitted to show internal structure of the top portion thereof.

A preferred embodiment of the relatively lightweight, vertical support stand for a water sprinkler head is shown in the drawings. Like parts in the various views shown in the drawings are identified with the same reference number.

The support stand comprises a central support hub shown generally by the reference number 10. The support hub 10 includes a top face 11 and circumscribing sides 12. As illustrated, the sides 12 comprise generally flat, rectangular panels and they slope slightly outwardly such that the perimeter at the bottom of the hub 10 is larger than the perimeter at the top. The vertical edges of the sides 12 are joined in a smooth arcuate juncture to form a structure generally resembling a truncated five-sided pyramid. The truncated, pyramidal shape is not an essential feature of the invention, and it is to be recognized that other shapes could be utilized.

The support hub 10 has a central, elongate opening 14 extending from the top 11 to the bottom of the hub 10. The bottom of the hub 10 is formed by a bottom wall 16 which includes means for receiving legs of the stand as will be explained further hereinafter. When assembled, the hub 10 forms a generally hollow enclosure with certain internal features as will be discussed further in the following disclosure.

One such internal feature of the hub 10 is a central cylindrical member 17 extending downwardly from the top 10 to the bottom 16. The top 11, sides 12 and central cylindrical member 17 of the hub 10 are preferably molded integrally from a polymeric material such as polycarbonate, nylons and acetals. The bottom 16 is also preferably molded of the same polymeric material and is attached such as by solvent gluing or plastic welding to the bottom perimeter of the sides 12. The bottom 16 preferably has a central opening therein in which the lower end of the central cylindrical member 17 is snugly received. The lower end of the cylindrical member 17 can be affixed such as by solvent gluing or plastic welding to the central opening in the bottom 16. The cylindrical opening through the cylindrical member 17 forms the central, elongate opening 14 through the hub 10 as referred to previously.

Means are provided for attaching a sprinkler head 18 to the top 11 of the support hub 10 such that the sprinkler head is in fluid flow communication with the opening 14 through the support hub 10. As illustrated, the sprinkler head 18 has a riser conduit 19 extending downwardly therefrom. The riser conduit 19 has male threads at its lower end which are threaded into corresponding female threads in the opening 14 at the top 11 of the hub 10 so that the riser conduit 19 is substantially coaxial with the elongate opening 14 in the hub 10.

Figure 4:
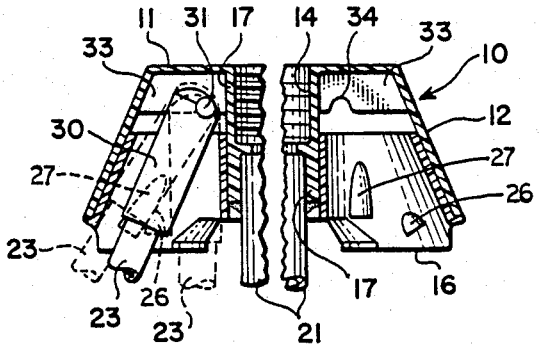
FIG. 4 is a cross section taken along line 4—4 of FIG. 2.
Figure 5:
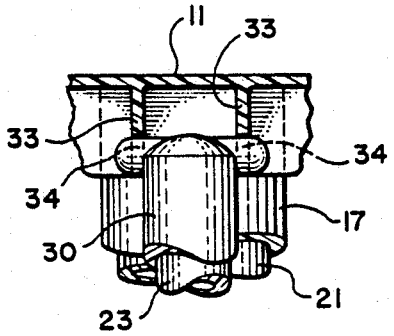
FIG. 5 is a partial cross section taken along line 5—5 of FIG. 3.
Figure 6:
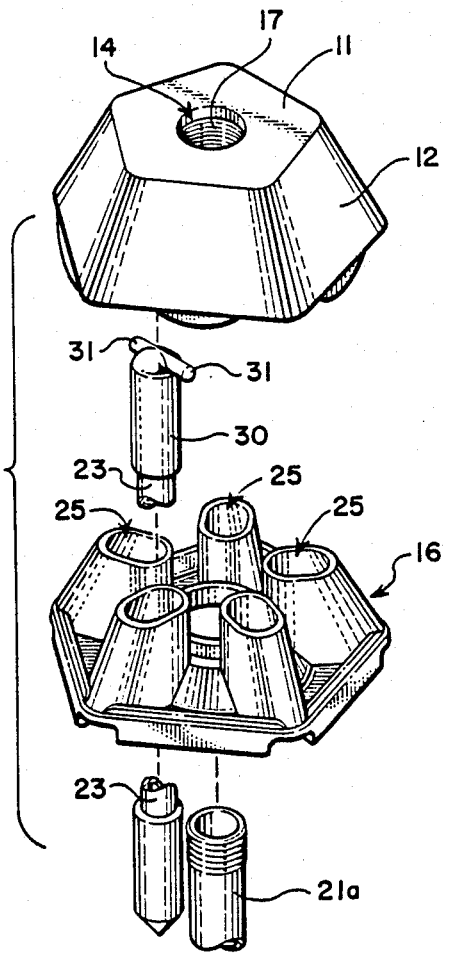
FIG. 6 is an exploded pictorial view of the stand of FIG. 1, with four of the legs being omitted for simplicity.

Means are further provided for coupling a water supply conduit 20 to the bottom of the support hub 10, such that the water supply conduit 20 is also in fluid flow communication with the elongate opening 14 through the hub 10. Two somewhat similar means are shown in the drawings. As shown in FIG. 4, a piece of plastic tubing 21 having an outside diameter which fits snugly within the lower end of the central cylinder 17 is secured in place in the lower end of the central cylinder 17 by solvent gluing or other gluing means. Alternatively, a compression fit, as is well known in the art, can be used to avoid gluing. As shown in FIG. 6, the plastic tubing **21*a* has a threaded upper end, and that end is threaded into internal threads (not shown) in the lower end of the central cylinder 17. In either of the two embodiments, the tubing 21 and 21*a* is preferably relatively short in length, with a quick disconnect or other coupling 22 at its free end. The coupling 22** is advantageously adapted to be quickly connected to the end of a hose or other somewhat flexible conduit which serves as a source of water under pressure.

At least five, flexible, elongate legs 23 are pivotally attached to the support hub 10 so as to be substantially equally spaced around the elongate opening 14 in the support hub 10 As illustrated, there are five legs 23 which are spaced in radial alignment with respective junctures of the sides of the pyramidal shaped hub 10. Five legs 23 are the preferred number, but more legs 23 could be used if so desired However, less than five legs 23 are not sufficient and will not accomplish the purposes of the present invention, inasmuch as a stand with four or less legs has been found to be unstable, i.e., the reactive forces of the water stream leaving the sprinkler head tend to tip the stand over.

The legs 23 are adapted to be positioned in an extended support position in which they extend outwardly and downwardly in an acute angle from a central axis of the support hub 10 which is substantially coaxial with the elongate opening 14 in the support hub Preferably, each of the legs 23 are pivotally attached at mutually respective one ends thereof to the support hub 10 such that the legs 23 can be moved from their extended support positions as shown in FIG. 1 to retracted positions in which the legs generally lie in a longitudinal bundle which is formed about and is substantially parallel with the central axis of the hub 10 as shown in phantom in FIG. 1. With the legs 23 in the retracted position, the stand is easily transported from one place to another or can be stored in a compact place.

The legs 23 are preferably made of lightweight, fiber reinforced plastic. In an especially preferred embodiment, the legs are formed by pultrusion such that the fibers in the resin or plastic material are generally aligned parallel to the longitudinal lengths of the legs 23. The legs 23 must be flexible and it has been found preferable for the legs 23 to comprise flexible rods which have a flexural modulus of between about 3 cm and 12 cm and preferably between about 3.5 cm and 10 cm. Flexible modulus for purposes of this invention, is defined as the deflection sustained by a rod which is supported by two supports spaced one meter apart and with a weight of ten kilograms applied at the center of the rod between the two spaced supports for the rod.

The combination of the flexibility of the legs 23 and the use of at least five legs has been found to produce a sprinkler stand which is very stable. Such a stand is practically immune from tipping over when the spray head is being used even when the device is being used under windy conditions. Using less than five legs 23 or making the legs to have a flexibility modulus less than that given above greatly reduces the stability of the stand, especially under windy conditions. Making the legs to have a modulus greater than that given above again imparts instability in the stand by making the stand excessively pliable whereby the spray head tends to oscillate or wobble. The stand does not tip over with the higher flexibility in the legs, but the instability of the spray head is not desirable.

The shorter the legs 23, the more the stand approaches a conventional ground elevation sprinkler unit. The present invention is directed to an elevated spray stand in which the spray head is elevated above foliage or other obstructions in the vicinity of the sprayer such that the sprayer can deliver water over the foliage or obstructions. For that purpose, the length of the legs 23 are preferably at least about 40 cm.

As mentioned above, the legs 23 are preferably adapted to swing in pivotal motions from extended positions extending outwardly at an acute angle from the central axis of the hub 10 to a retracted position in which the legs 23 generally lie in a longitudinal bundle which is substantially parallel with the central axis of the hub 10. In the preferred embodiment, as illustrated in the drawings, the hub 10 is provided with slotted receptacles 25 to accomodate the swinging pivotal movement of the legs 23. A slotted receptacle 25 is provided for each leg 23, with the slotted receptacle being formed in the bottom member 16 of the hub 10. The slotted receptacles 25 extend radially outwardly from the central axis of the hub 10. The upper ends of the respective legs 23 are received in mutually respective receptacles 25.

Means are provided for releasably retaining each leg 23 in its extended and retracted position. Preferably, means are also provided for releasably retaining each leg 23 in a mid position between its extended and retracted positions. As illustrated, these means comprises sets of rounded protuberances 26 and 27 positioned on the opposed longitudinal sides of each of the receptacles 25, such that the sides of the legs 23 located within the receptacle 25 make forced sliding movement over the pairs of rounded protuberances as the legs 23 swing in their pivotal movement within the receptacles 25.

A first pair of rounded protuberances 26 is located in each of the receptacles 25, with the first pairs of protuberances 26 being spaced from the outer, radially extending ends of the receptacles 25, such that as the respective legs 23 make forced sliding movement over the mutually respective first pairs of protuberances 26, each of the legs 23 snaps into a retained position between the first pair of prutuberances and the outer, radially extending ends of the receptacles 25. The legs 23 can be moved in forced sliding movement over the first pair of protuberances 26 to swing back in the receptacle 25 toward the retracted position.

A second pair of rounded protuberances 27 is preferably located on the opposite longitudinal sides of each of the slotted receptacles 25. The second pair of protuberances 27 is spaced from the first pair 26 such that the sides of the legs 23 make a forced sliding movement over the second pair of protuberances 27 at an intermediate position in the pivotal movement of the legs 23. In the intermediate position, the legs 23 are retained in position between the first and second pairs of protuberances. The legs 23 can be moved further over the first pair of protuberances to the extended position, or the legs 23 can be moved back over the second pair of protuberances 27 to the retracted position in which the legs 23 are held in the retracted position between the second pair of protuberances 27 and the inner radially extending ends of the receptacles 25.

In the preferred embodiment illustrated in the drawings, each of the legs 23 comprises an elongate flexible rod with an elongate cylindrical fitting 30 at the upper end thereof. The cylindrical fitting 30 has an upper end which is pivotally secured to the support hub 10 such that the cylindrical fitting 30 extends through the mutually respective slotted receptacle 25 to swing back and forth therein The elongate, flexible rod extends from the lower end of the cylindrical fitting 30. In such embodiment, the cylindrical sides of the cylindrical fitting make the forced sliding movement over the first and second pairs of rounded protuberances 26 and 27.

In the embodiment illustrated in the drawings, the means for pivotally connecting the upper ends of the cylindrical fittings 30 to the support hub 10 comprises a pair of knobs or ears 31 extending outwardly in opposite directions at the top end of each of the cylindrical fittings 30. Five pairs of webs 33 are formed in the top of the hub 10, with a pair of webs 33 for each leg 23. Each pair of webs 33 has a pair of notches 34 cut in the lower edges of the webs 33. The webs in each pair of webs are spaced from each other by a distance equal to the outside diameter of the cylindrical fitting 33. The ears 31 on the cylindrical fittings are thus adapted to fit within the notches 34 in respective webs of each pair of webs 33.

To retain the ears 31 in position in the notches 34 of the webs 33, the sidewalls of the slotted receptacles 25 extend upwardly within the hub 10 such that the upper ends of the receptacles 25 abut the lower edges of the webs 33. When the bottom 16 containing the receptacles 25 is glued into place and united with the side walls 12 and top 11 of the hub 10, the ears 31 on the cylindrical fittings 30 of the legs 23 are enclosed in the notches 34 of the webs 33 for pivotal movement of the legs 23 about a pivot axis through the ears 31.

Figure 7:
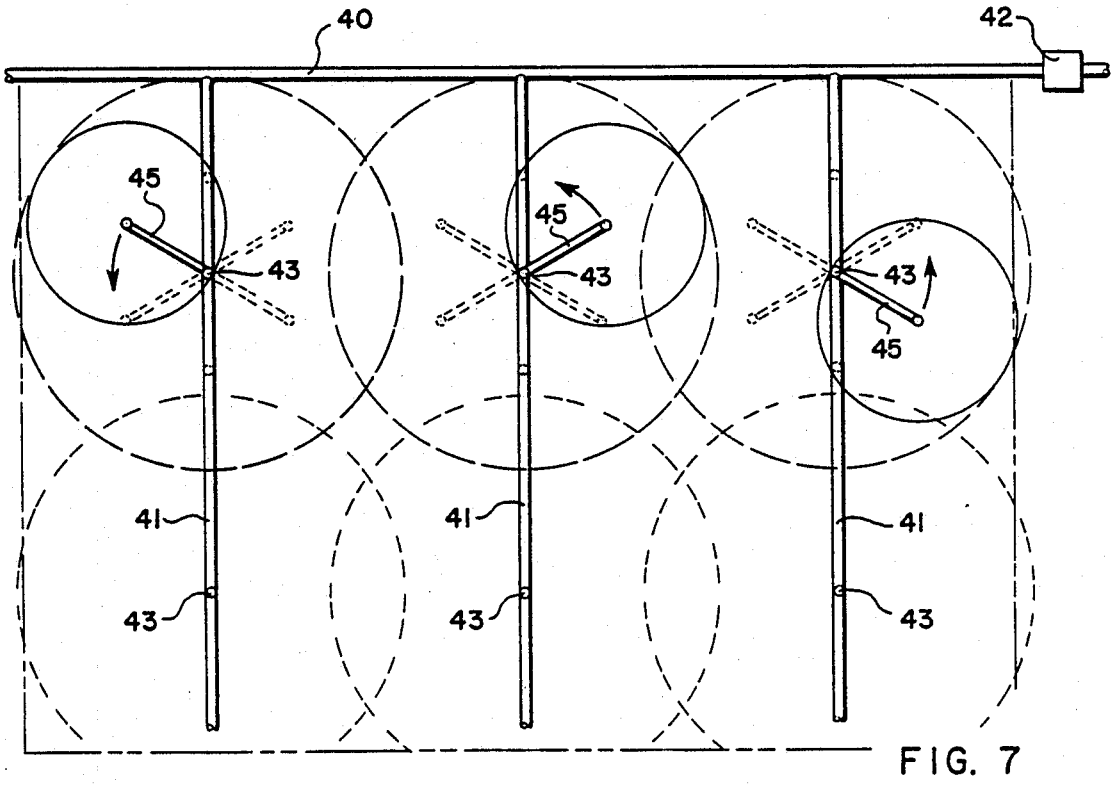
FIG. 7 is a schematic diagram of an agricultural irrigation system in accordance with the invention in which at least one of the support stands of FIG. 1 are advantageously used.

The sprinkler stands as illustrated and described are advantageously used in a novel agricultural irrigation system as shown in FIG. 7 of the drawings. A header conduit 40 is provided across the parcel of land to be irrigated. The header conduit must be of sufficient size to supply water under pressure to several lateral conduits 41 which are spaced along the header conduit 40 and extend outwardly in a direction away from the header conduit 40. The header conduit 40 will generally be three inches or more in diameter as required. The lateral conduits can be much smaller, such as one to two inches. A pump 42 or other means is provided for supplying water under pressure to the header conduit 40.

Each of the lateral conduits have quick disconnect couplings 43 spaced therealong. A sprinkler stand and spray head, such as shown in FIG. 1 and described previously, is g provided with a flexible conduit 45 extending therefrom. The free end of the flexible conduit 45 is adapted to engage the quick disconnect couplings in the lateral conduits 41. The spray stand and sprinkler can be connected to a lateral conduit 41 through the flexible conduit 45 and then moved to several locations around that particular quick disconnect coupling so as to irrigate a large area around that coupling The stand, sprinkler and flexible conduit 45 can then be moved to the next quick disconnect coupling to water the area around that coupling.

By limiting the number of sprayers connected at any one time to the lateral conduits 41, the size of the lateral conduits is minimized and is much smaller than in presently used systems where a plurality of sprayers are permanently installed in the lateral conduits. The spray stands and sprayers of this invention are lightweight and easily moved. In addition, they are relatively inexpensive. The reduced size of the lateral conduits 41 greatly reduce the cost of the piping system. The irrigation system of the present invention thus provides an inexpensive alternative which can be used in small farms wherein it is impractical to use the more costly systems used in larger operations. By providing the flexible conduit 45 for each sprinkler unit of the present invention, a greater area can be watered around each quick disconnect coupling in the lateral conduits 41. This minimizes the footage of lateral conduit 41 required to water an area and again reduces the cost of the system. Because of the reduced expense of the system, the header conduit 40 and the lateral conduits 41 can generally be left in place throughout the growing season without requiring moving of the piping system from one field to another.

It is to be understood that the present disclosure, including the detailed description of the preferred embodiments of the invention, is made by way of example and that various other embodiments are possible without departing from the subject matter coming within the scope of the following claims, which subject matter is regarded as the invention.

I claim:

1. A vertical support stand for use with a sprinkler head which is of the type that generates reactive lateral forces in response to expelled water, said stand comprising a central support hub having a top and a bottom, with an elongate opening extending from said top to said bottom of said support hub;

a riser conduit extending upwardly from the opening at the top of said support hub, said riser conduit being fixed relative to said support hub;

coupling means for attaching the sprinkler head to the extending end of said riser conduit;

at least five, flexible, elongate legs attached to said support hub so as to be substantially equally spaced around the elongate opening in said support hub such that the legs can be positioned in an extended support position in which they extend outwardly in an acute angle from a central axis; with each of said legs comprising a flexible rod having sufficient flexibility to cooperatively dissipate the reactive forces generated by said sprinkler head and transferred into said legs, such that the stand is stable during operation; and means for coupling a conduit to the bottom of said support hub in flow communication with the central, elongate opening in said support hub for supply of a pressurized source of water through the central elongate opening to said riser and an attached sprinkler head.

2. A vertical support stand in accordance with claim 1, wherein each of said flexible legs comprise a flexible rod having a length of at least 40 cm and further having a flexural modulus of between about 3 cm and 12 cm.

3. A vertical support stand in accordance with claim 1, wherein each of said flexible legs is pivotally attached at mutually respective one ends thereof to said support hub such that the flexible legs can be moved from their extended support positions to retracted positions in which the legs generally lie in a longitudinal bundle which is formed about and is substantially parallel with said central axis.

4. A vertical support stand in accordance with claim 3, wherein a slotted receptacle is provided in said support hub for each leg, with the slotted receptacles being oriented so as to extend radially outwardly from said central axis and further with the respective ends of each of the legs being received in a mutually respective slotted receptacle.

5. A vertical support stand in accordance with claim 4, further comprising a first pair of rounded protuberances on said opposed longitudinal sides of each of said slotted receptacles, with the sides of said legs making forced sliding movement over said first pair of rounded protuberances such that each leg snaps into a retained position between the first pair of rounded protuberances and the outer end of the respective slotted receptacle.

6. A vertical support stand in accordance with claim 5, further comprising a second pair of rounded protuberances on the opposed longitudinal sides of each of said slotted receptacles, with the second pair of rounded proturberances being spaced from the first pair of rounded protuberances such that the sides of said legs make a forced sliding movement over said second pair of rounded protuberances at an intermediate position in the movement of the leg, whereby the leg is retained in said intermediate position between the first and second pair of rounded protuberances.

7. A vertical support stand in accordance with claim 5 in which each of said legs comprises an elongate, cylindrical fitting and an elongate, flexible rod extending from said cylindrical fitting, with the cylindrical fitting further having an upper end and a lower end, with the upper end being secured to said support hub such that said cylindrical fitting extends through a mutually respective from said receptacles to swing back and forth within the mutually respective slotted receptacle, wherein the cylindrical sides of said cylindrical fitting make forced sliding movement over said first pair of rounded protuberances to snap into said retained position between the first pair of protuberances and the outer end of said slotted receptacle, and wherein said elongate, flexible rod extends from the lower end of said cylindrical fitting.

8. A vertical support stand in accordance with claim 7, further comprising a second pair of rounded protuberances on the opposed longitudinal sides of each of said slotted receptacles, with the second pair of rounded protuberances being spaced from the first pair of rounded protuberances such that the cylindrical sides of said cylindrical fittings make a forced sliding movement over said second pair of rounded protuberances at an intermediate position in the movement of the cylindrical fitting whereby the cylindrical fitting is retained in said intermediate position between the first and second pair of rounded protuberances.

9. An agricultural irrigation system comprising a header conduit extending across a parcel of land to be irrigated;

means for providing water under pressure to the header conduit;

lateral conduits spaced along said header conduit and extending outwardly in a direction away from said header conduit;

a plurality of quick disconnect couplings spaced along each of said lateral conduits; and at least one portable sprinkler unit comprising a central support hub having a top and a bottom, with a central, elongate opening extending from said top to said bottom of said support hub;

a riser conduit extending upwardly from the opening at the top of said support hub, said riser conduit being fixed relative to said support hub;

a sprinkler head coupled to the extending end of said riser conduit, said sprinkler head being of the type that produces a reactive, lateral force on the riser conduit;

at least five, flexible, elongate legs attached to said support hub so as to be substantially equally spaced around the elongate opening in said support hub such that the legs can be positioned in an extended support position in which they extend outwardly in an acute angle from a central axis which is substantially coaxial with said elongate opening in said support hub, with said legs comprising flexible rods having sufficient flexibility to dissipate the reactive force of said sprinkler head through the legs such that the stand is stable during operation;

a flexible supply conduit having a first and second end, with the first end attached to the bottom of said support hub in flow communication with the central, elongate opening in said support hub; and means for releasably coupling the second end of said flexible supply conduit to any of the plurality of quick disconnect couplings on said lateral conduits.

10. An agricultural irrigation system in accordance with claim 9, wherein each of said flexible legs of said portable sprinkler unit is pivotally attached at mutually respective one ends thereof to said support hub such that the flexible legs can be moved from their extended support positions to retracted positions in which the legs generally lie in a longitudinal bundle which is formed about and is substantially parallel with said central axis.

11. An agricultural irrigation system in accordance with claim 10, wherein a slotted receptacle is provided in said support hub for each leg, with the slotted receptacle being oriented so as to extend radially outwardly from said central axis and further with the respective ends of each of the legs being received in a mutually respective slotted receptacle.

12. An agricultural irrigation system in accordance with claim 11, further comprising a first pair of rounded protuberances on opposed longitudinal sides of each of said slotted receptacles, with the sides of said legs making forced sliding movement over said first pair of rounded protuberances such that each leg snaps into a retained position between the first pair of rounded protuberances and the outer end of the respective slotted receptacle.

13. An agricultural irrigation system in accordance with claim 12, further comprising a second pair of rounded protuberances on the opposed longitudinal sides of each of said slotted receptacles, with the second pair of rounded protuberances being spaced from the first pair of rounded protuberances such that the sides of said legs make a forced sliding movement over said second pair of rouned protuberances at an intermediate position in the movement of the leg whereby the leg is retained in said intermediate position between the first and second pair of rounded protuberances.

14. An agricultural irrigation system in accordance with claim 12 in which each of said legs comprises an elongate, cylindrical fitting and an elongate, flexible rod extending from said cylindrical fitting, with the cylindrical fitting further having an upper end and a lower end, with the upper end being pivotally secured to said support hub such that said cylindrical fitting extends through a mutually respective one of said receptacles to swing back and forth within the mutually respective slotted receptacle, wherein the cylindrical sides of said cylindrical fitting make forced sliding movement over said first pair of rounded protuberances to snap into said retained position between the first pair of protuberances and the outer end of said slotted receptacle, and wherein said elongate, flexible rod extends from the lower end of said cylindrical fitting.

15. An agricultural irrigation system in accordance with claim 14, further comprising a second pair of rounded protuberances on the opposed longitudinal sides of each of said slotted receptacles, with the second pair of rounded protuberances being spaced from the first pair of rounded protuberances such that the cylindrical sides of said cylindrical fittings make a forced sliding movement over said second pair of rounded protuberances at an intermediate position in the movement of the cylindrical fitting whereby the cylindrical fitting is retained in said intermediate position between the first and second pair of rounded protuberances.

* * * * *